US009003618B2

(12) United States Patent
Violato

(10) Patent No.: US 9,003,618 B2
(45) Date of Patent: Apr. 14, 2015

(54) REINFORCING EYELET FOR A HOLE

(71) Applicant: Ernesto Violato, Piove di Sacco (IT)

(72) Inventor: Ernesto Violato, Piove di Sacco (IT)

(73) Assignee: Riri S.A., Mendrisio (CH)

( * ) Notice: Subject to any disclaimer, the term of this patent is extended or adjusted under 35 U.S.C. 154(b) by 0 days.

(21) Appl. No.: 13/956,925

(22) Filed: Aug. 1, 2013

(65) Prior Publication Data

US 2014/0033474 A1 Feb. 6, 2014

(30) Foreign Application Priority Data

Aug. 2, 2012 (IT) ..... BO2012A0426

(51) Int. Cl.

| | |
|---|---|
| ***A43C 5/00*** | (2006.01) |
| ***A41F 1/02*** | (2006.01) |
| ***A44B 13/00*** | (2006.01) |

(52) U.S. Cl.

CPC ..... *A41F 1/02* (2013.01); *A44B 13/0082* (2013.01)

(58) Field of Classification Search

CPC ..... A44B 13/0082
USPC ..... 24/713.7, 713.8; 16/2.1
See application file for complete search history.

(56) References Cited

U.S. PATENT DOCUMENTS

| | | | | |
|---|---|---|---|---|
| 973,568 | A * | 10/1910 | Russell | 439/552 |
| 2,583,719 | A * | 1/1952 | White | 16/2.1 |
| 3,328,854 | A * | 7/1967 | Tombari | 16/2.1 |
| 3,399,435 | A | 9/1968 | Ackerman, Jr. | |
| 3,512,224 | A * | 5/1970 | Newton | 411/447 |
| 3,653,353 | A * | 4/1972 | Davis | 114/115 |
| 3,812,809 | A * | 5/1974 | Salmon | 114/114 |
| 3,979,798 | A * | 9/1976 | Meyer | 16/2.1 |
| 4,372,013 | A * | 2/1983 | Gautier, Jr. | 16/2.1 |
| 4,479,289 | A | 10/1984 | Rutgersson | |
| 8,096,017 | B2 * | 1/2012 | Van Walraven et al. | 16/2.1 |
| 2012/0317760 | A1 | 12/2012 | Kamiya et al. | |

FOREIGN PATENT DOCUMENTS

| | | |
|---|---|---|
| FR | 2 519 100 | 7/1983 |
| GB | 2 134 616 A | 8/1984 |
| WO | WO 2011/104867 A1 | 9/2011 |

OTHER PUBLICATIONS

Italian Search Report issued in Application No. BO20120426 dated Apr. 12, 2013 (7 pages).

* cited by examiner

*Primary Examiner* — Victor Batson
*Assistant Examiner* — Matthew Sullivan
(74) *Attorney, Agent, or Firm* — Flynn, Thiel, Boutell & Tanis, P.C.

(57) ABSTRACT

A reinforcing eyelet for a hole, comprising two annular metal plates (3, 23, 43; 5, 25, 45) capable of being fastened, in use, the one opposed to the other on a substrate (T). An annular pad (12, 32, 52) placed adjacent to a first (5, 23, 45) of the two annular metal plates and intended to make contact, in use, with the substrate (T) in order to improve its bond to the reinforcing eyelet. The outer edge (15, 33, 53) of the said first annular metal plate (5, 23, 45) being folded over part of the annular pad (12, 32, 52) in order to hold it and conceal it from view in the fastened condition of the reinforcing eyelet.

21 Claims, 6 Drawing Sheets

REINFORCING EYELET FOR A HOLE

FIELD OF THE INVENTION

The present invention relates to a reinforcing eyelet for a hole.

The invention has been developed with particular regard, although not exclusively, to a reinforcing eyelet for a hole comprising two annular metal plates capable of being fastened together in use, the one opposed to the other on a substrate (T).

BACKGROUND OF THE INVENTION

In the most typical applications, metal reinforcing eyelets consist of a tubular body with a tubular shank and a flat flange, which is opposed to a washer. The tubular shank is intended to cut, for example, a fabric by making a hole of a size equal to its diameter. The tubular shank is then peened on to the washer that is placed on the other side of the fabric, which is thus pinched between the flange and the washer. Types of reinforcing eyelets also exist in which both elements comprise two respective tubular bodies, capable of being inserted one into the other and reciprocally deformable to fasten the reinforcing eyelet on to the substrate.

Metal reinforcing eyelets have applications on a wide variety of materials. However, their use on fine or delicate fabrics, such as elasticated or thin fabrics, is limited by poor retention of the fabric, which can easily slip out of the grip between the flange and washer. The problem stems from the fact that the two essentially flat portions of the eyelet, i.e. the flange of the tubular body and the washer that it opposed to it, are generally two thin metal plates between which it is difficult to grip a thin fabric well without damaging it or without creating wrinkles or creases that are unacceptable from an aesthetic point of view.

To solve this problem, it has been thought to interpose, between the fabric and one of the two flat portions of the eye, a felt or rubber disc that improves the friction between the fabric and the reinforcing eyelet. However, this solution is not entirely satisfactory from an aesthetic point of view, because the disc is visible and this reduces the desirability and value of the metal reinforcing eyelet. For this same reason, no consideration is given to the alternative of eyelets made from plastic material, since this is clearly of little interest and rarely used on valuable garments and products of a certain level.

SUMMARY OF THE INVENTION

The aim of the present invention is to solve the problems of the prior art, and particularly to provide a reinforcing eyelet for a hole that provides optimal grip even for fine, delicate or elasticated fabrics and is also aesthetically pleasing once applied. A further aim is to provide a reinforcing eyelet for a hole that is inexpensive to produce and easy to apply, as well as being reliable and durable in use.

In order to achieve the aims indicated above, the present invention relates to a reinforcing eyelet of the type indicated above in the preamble, further comprising an annular pad placed adjacent to a first of the two annular metal plates and intended to make contact, in use, with the substrate in order to improve its bond to the reinforcing eyelet. The outer edge of the said first annular metal plate is folded over part of the annular pad in order to hold it and conceal it from view in the fastened condition of the reinforcing eyelet.

A reinforcing eyelet of this type is aesthetically pleasing to the eye because all its visible parts are made of metal. The annular pad serves to keep the substrate fastened between the two annular metal plates of the reinforcing eyelet, even when the substrate is very fine, delicate or elasticated.

According to an advantageous embodiment, the annular pad has at least one protruding portion with respect to the outer edge of the said first annular metal plate. The protruding portion of the annular pad is therefore more internal with respect to the folded outer edge of the annular metal plate that holds it. Thanks to the differentiated thickness, the annular pad adequately compresses even a very fine substrate, which is thus retained securely thanks to the greater friction exerted upon it.

Advantageously, the reinforcing eyelet of the present invention also comprises two engagement elements or means, respectively associated with the two annular metal plates. These two engagement elements interact with each other in the use of the reinforcing eyelet, namely when the eyelet is fastened on the substrate. The two above-mentioned engagement elements respectively comprise a plurality of protrusions and a backing element for the protrusions. The annular pad forms an integral part of one of the two engagement elements, i.e. of the protrusions or of their backing element. These protrusions locally increase the grip and the pressure exercised on the substrate, and therefore significantly decrease the risk of it being pulled out of the reinforcing eyelet.

More specifically, the protrusions may be made of metal, produced of a piece with the annular metal plate. In this case, the annular pad mounted on the other annular metal plate acts as a backing, and is capable of deforming—when the reinforcing eyelet is fitted on a substrate—at the points of the protrusions, in order to increase the surface area of contact with the substrate.

Preferably, these metallic protrusions are obtained by plastic deformation of the annular metal plate during its manufacture by cutting and pressing. In this case, the visible side of the annular metal plate is preferably covered by a cap that conceals from view the depressions otherwise visible on the annular metal plate, at the points of the protrusions. The arrangement of the covering cap is not, however, linked solely to this embodiment, but can also be provided in other variants of the reinforcing eyelet of the present invention, in order to allow a high degree of freedom of customisation of the eyelet in a simple and economical manner.

Advantageously, the protrusions are essentially conical with a rounded extremity so that they do not pierce or otherwise damage the fabric or substrate to which the eyelet is fixed.

According to other embodiments of the invention, the protrusions are preferably made from a pliable material and can be formed directly of a piece with the annular pad. These protrusions may match up, on the other component of the reinforcing eyelet, with backing means consisting of another annular pad or the said annular metal plate. These variants are particularly indicated in the case of very small eyelets, in which it can be more complex to create the protrusions directly of a piece with the metal flange.

BRIEF DESCRIPTION OF DRAWINGS

Further features and advantages will become apparent from the following detailed description of preferred embodiments of the invention, with reference to the accompanying drawings, provided by way of non-limiting example, in which.

DETAILED DESCRIPTION

Figure 1:
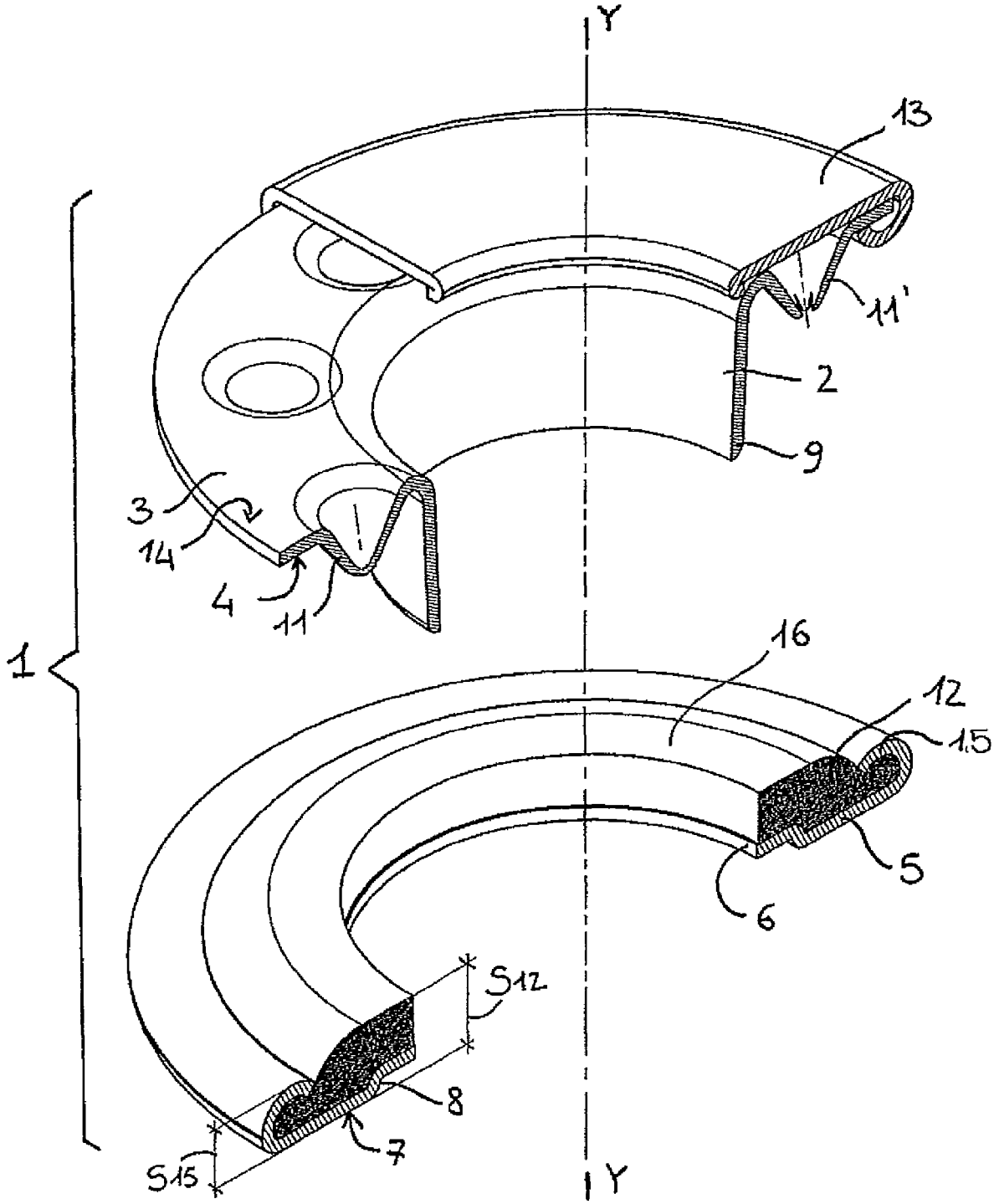
FIG. 1 illustrates the components of an eyelet according to a first embodiment of the invention.
Figure 2:
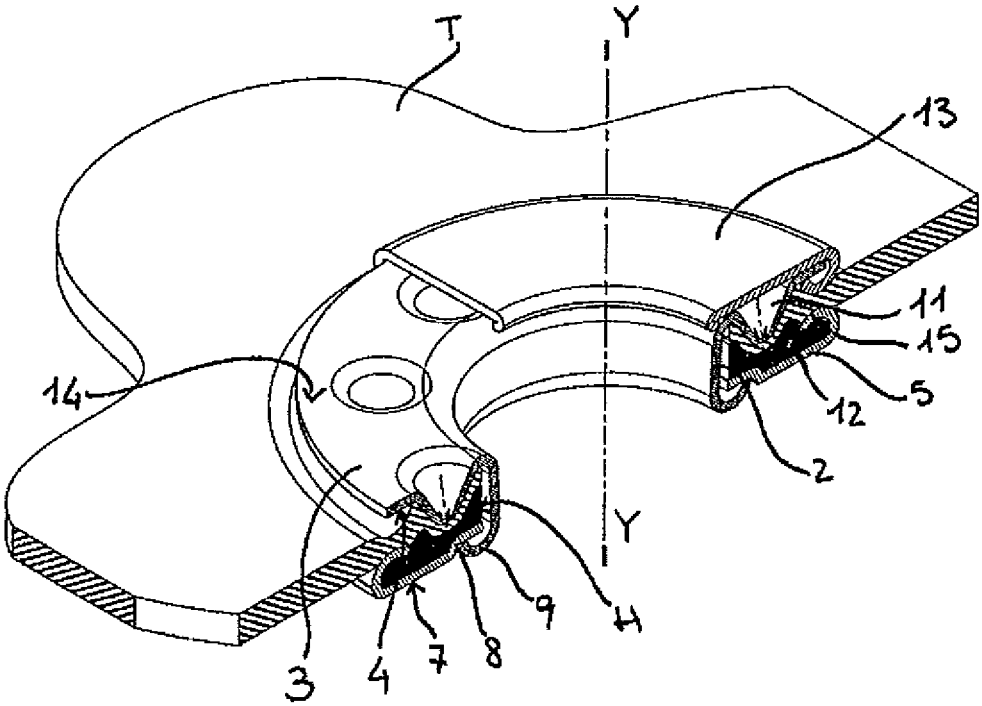
FIG. 2 shows the assembled components of FIG. 1.

With reference now to FIGS. 1 and 2, the reference number 1 generically indicates a reinforcing eyelet for a hole H made in a substrate T, which typically, although not exclusively, may be a fabric, especially a fine, delicate and/or elasticated fabric. The reinforcing eyelet 1 comprises a deformable tubular body 2, preferably made from metal or similar material, which extends along an axis Y-Y and is provided at its extremity with a flange 3. The flange 3 has a lower face 4 that faces in the same direction as the extension of the tubular body 2.

The reinforcing eyelet 1 also comprises a washer 5, essentially in the form of a disc with a hole 6 and at least one front face 7, preferably essentially flat. The washer 5 may also have a step 8 against which the tubular body 2 is folded during the application of the eyelet to a substrate, as described in greater detail below.

On the washer 5 is set an annular pad 12, preferably in the form of a disc and made from a relatively pliable material, for example plastic, rubber, felt or similar. The annular pad 12 is held against the washer 5 by an edge 15 of the same washer, folded on to a portion of the annular pad 12. The annular pad 12 and the washer 5 have, in an inner portion 16 of the eyelet, an overall thickness S12 greater than the thickness S15 of the folded edge 15. In other words, the annular pad 12 protrudes in its innermost portion, from the side that is intended to make contact with the substrate T, with respect to the folded edge 15 of the washer 5.

From the lower face 4 of the flange 3 extend protrusions 11, 11', which in use point in the direction of the substrate T and are preferably distributed regularly on a circumference. The protrusions 11, 11' are preferably obtained by plastic deformation of the flange 3, which is then preferably covered by a covering cap 13 to conceal the depressions at the points of the protrusions 11, 11' on the visible face 14 of the flange 3. Optionally, logos or decorations in general may be imprinted on the covering cap 13.

The protrusions 11 are preferably rounded at the tip, but since the tubular element 2 is produced by cutting and pressing of a metal sheet, for example brass, the material could tear, giving rise to protrusions 11' with a perforated or pointed tip.

For the application of the reinforcing eyelet 1, the tubular body 2 is inserted in the hole H of the substrate T, if the hole is already made, or is pressed on to the substrate T with pressure such that the extremity 9 of the tubular body 2 cuts the substrate T to create the hole H.

On the opposite side of the substrate T, from which protrudes the extremity 9 of the tubular body 2, is then placed the washer 5, to which is attached the annular pad 12 that comes into contact with the substrate T. The flange 3 and the washer 5 are fastened against each other, in such a manner that the substrate T is gripped between the flange 3 and the annular pad 12, which preferably but not limitatively is made from a relatively pliable material and deforms overall against the substrate T and locally at the points of the protrusions 11, 11' of the flange 3, as clearly illustrated in FIG. 2.

A tool of a type generally known, whether manual, semi-automatic or automatic, is used to peen on to the washer 6 the extremity 9 of the tubular body 2, which is thus folded outwards, preferably against the step 8 of the washer 5, causing the reinforcing eyelet to be fastened on to the substrate T.

In the fitted configuration shown in FIG. 2, the protrusions 11 and 11' press the substrate against the pad 12, which is locally compressed, providing a broad surface area of contact with the substrate. The pad 12 and the protrusions thus maintain the substrate in position and effectively prevent it from slipping even when the substrate is fine, delicate and/or elastic.

Figure 3:
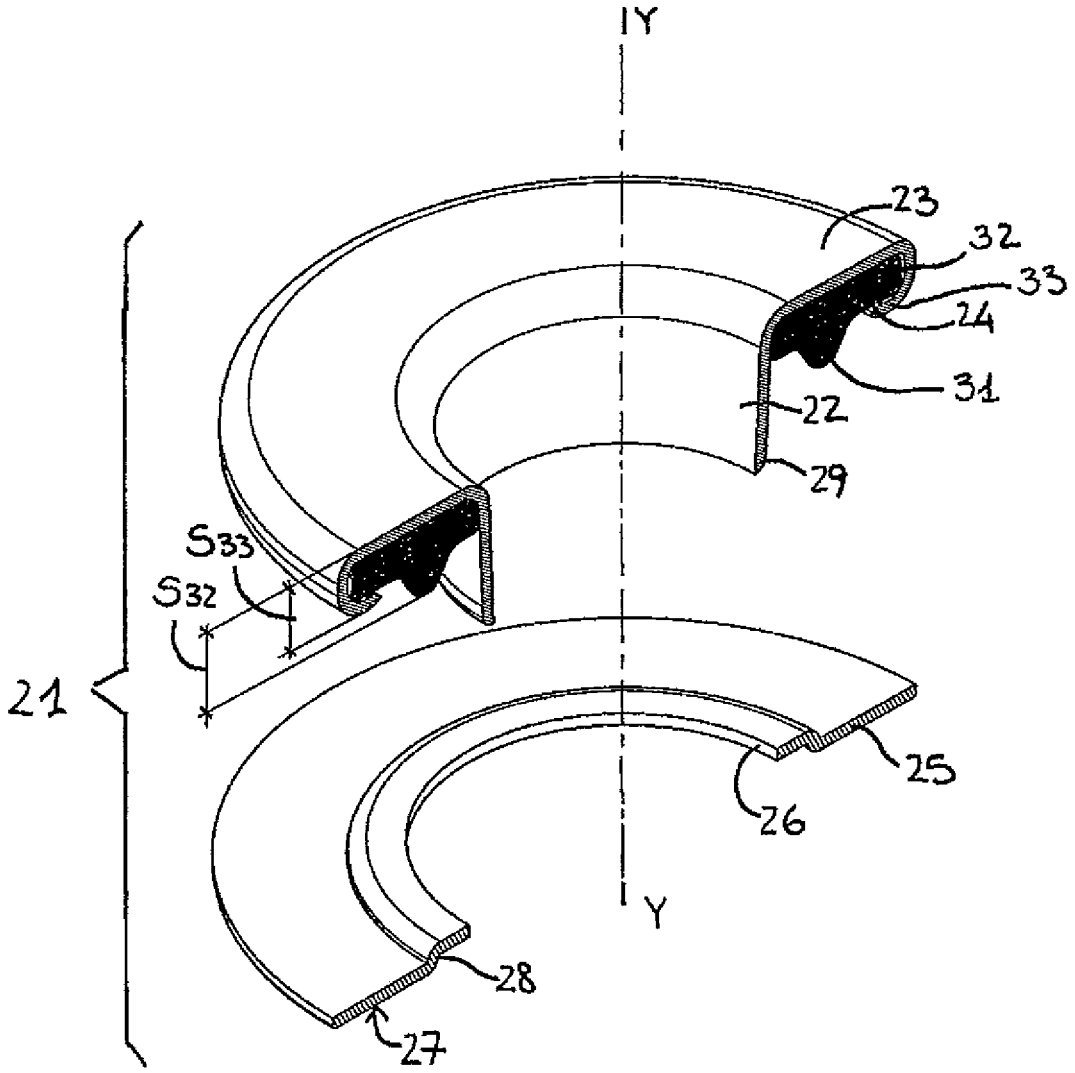
FIG. 3 shows a second embodiment of the invention.
Figure 4:
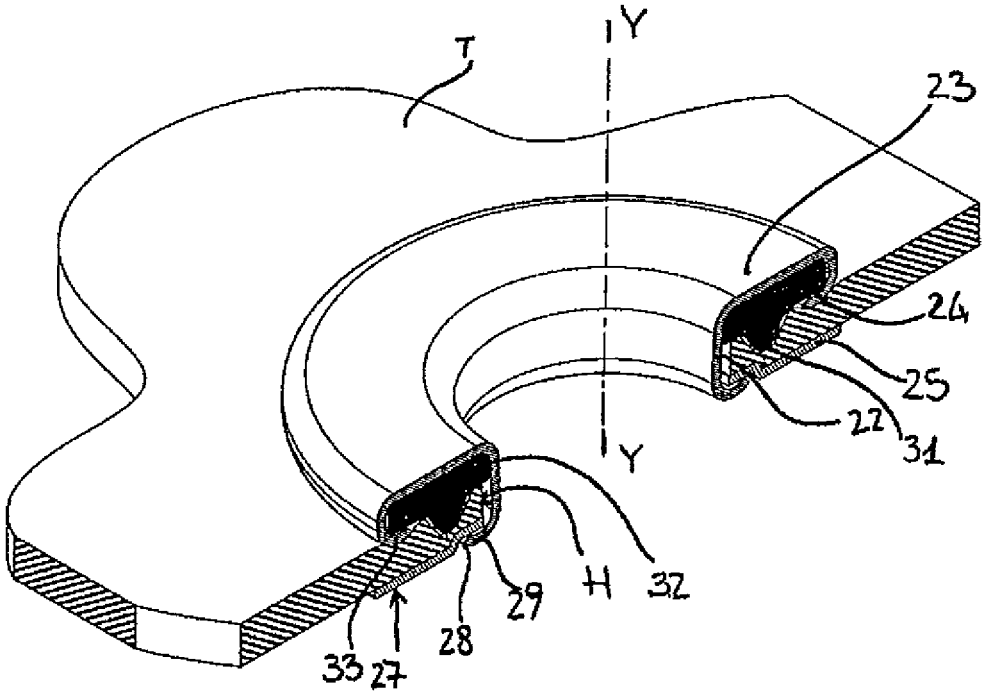
FIG. 4 shows the assembled components of FIG. 3.

In a second embodiment, illustrated in FIGS. 3 and 4, a reinforcing eyelet 21 for a hole H made in a substrate T comprises a deformable tubular body 22 provided at its extremity with a flange 23 having a lower face 24 that faces in the same direction as the extension of the tubular body 22.

The reinforcing eyelet 21 also comprises a washer 25, essentially in the form of a disc with a hole 26 and at least one front face 27, preferably essentially flat. The washer 25 may also have a step 28 against which is folded the tubular body 22 during the application of the eyelet to a substrate, as already described for the washer 5 of the eyelet 1.

An annular pad 32, preferably made from a relatively pliable material such as plastic, rubber or felt, is held fastened to the lower face 24 of the flange 23 by its outer edge 33, folded on to a portion of the annular pad 32. The annular pad 32 is provided with protrusions 31, preferably distributed regularly on a circumference, at which points the overall thickness S32 of the annular pad and the flange is preferably greater than the thickness S33 of the folded edge 33.

The application of the reinforcing eyelet 21 is entirely similar to that of the eyelet 1 described above: here too, the extremity 29 of the tubular body 22 is inserted into the hole H of the substrate T or used to create the said hole by cutting the substrate T, and then on to it is placed the washer 25 which, together with the flange 23, provided with the annular pad 32, compresses the substrate T. The extremity 29 of the tubular body 22 is then peened on to the washer 25 so that the extremity 29 of the tubular body 22 is folded outwards, preferably against the step 28 of the washer 25. When the reinforcing eyelet 21 is in the fitted configuration, illustrated in FIG. 4, the protrusions 31 integral to the annular pad 32 press the substrate T against the washer 25, maintaining it in position, especially where the substrate is fine, delicate and/or elastic.

Figure 5:
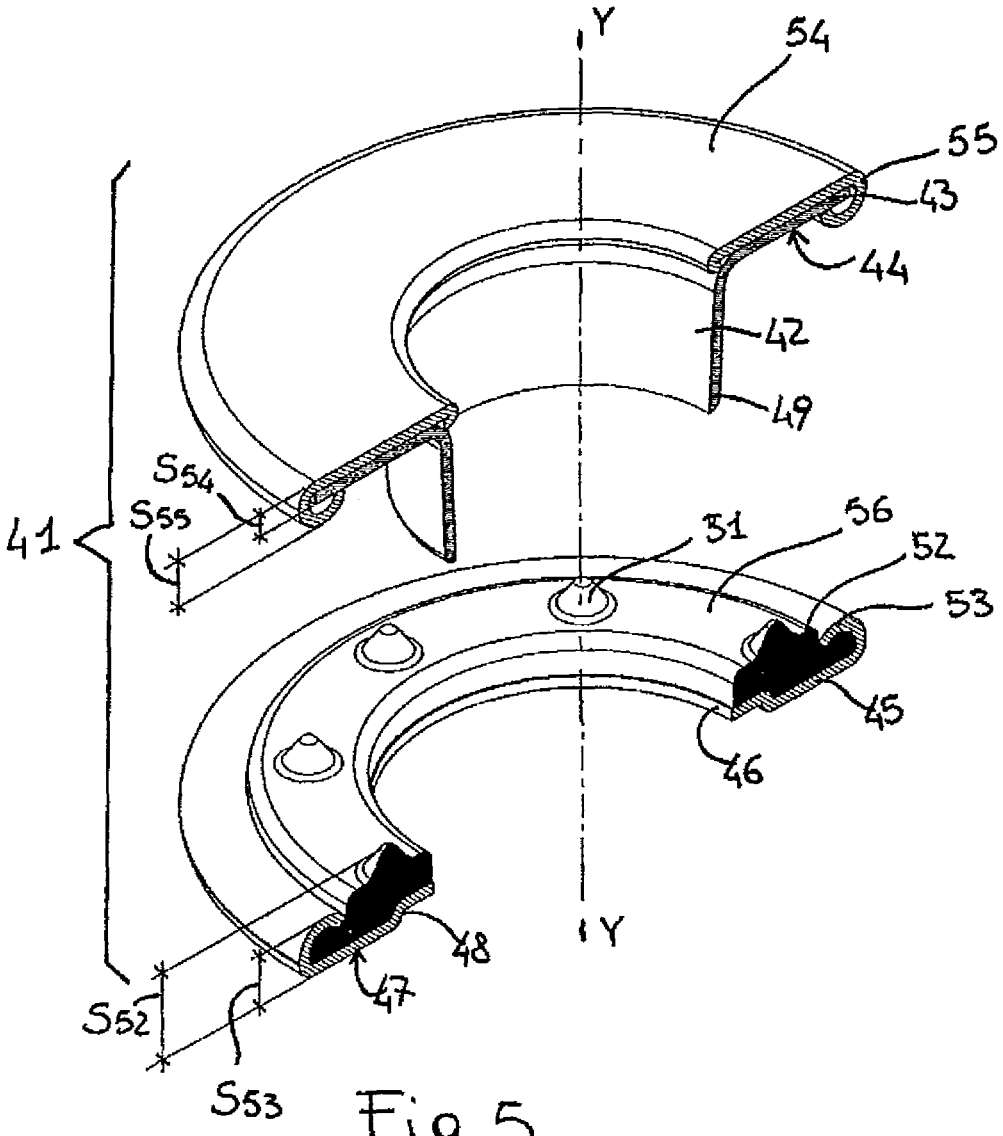
FIG. 5 shows a third embodiment of the invention.

In a third embodiment of the present invention, as illustrated in FIG. 5, a reinforcing eyelet 41 for a hole H made in a substrate T comprises a deformable tubular body 42 provided at its extremity with a flange 43 having a lower face 44 that faces in the same direction as the extension of the tubular body 42. The illustrated embodiment also shows a cap 54 coupled to the flange, on which may be imprinted symbols, designs, trademarks or any other desired sign. The cap 54 is anchored to the flange 43 by means of its edge 55 folded beneath the outer edge of the flange 43.

The reinforcing eyelet 41 also comprises a washer 45, essentially in the form of a disc with a hole 46 and at least one front face 47, preferably essentially flat. The washer 45 may also have a step 48 against which the tubular body 42 is folded during the application of the eyelet to a substrate, as already described in the previous embodiments.

An annular pad 52, preferably made from a flexible material similar to that of the annular pad 32 of the second embodiment, is placed upon the washer 45 and held against it by an edge 53 of the washer, folded on to a portion of the annular pad 52. Also on the annular pad 52, at the points of the protrusions 51, the overall thickness S52 of the annular pad 52 and the washer is preferably greater than the thickness S53 of the folded edge 53.

In this configuration, both the cap 54 and the washer 45 have both their respective metal edges 55, 53 folded, giving them a greater thickness. To prevent the substrate T being gripped only between these two metal edges, the annular pad 52, in addition to the protrusions 51, also has an annular zone 56 with a uniformly increased thickness. Overall, the maximum thickness S52 reached by the combination of the washer 47 and the annular pad 52 is preferably sufficiently greater than the thickness S53 of the edge 53 to compensate for the difference between the thickness S55 of the edge 55 and the thickness S54 of the overlap of flange and cap.

To apply the reinforcing eyelet 41, the extremity 49 of the tubular body 42 is inserted into the hole H of the substrate T, or cuts a portion of the substrate T to create the hole H. On to this is then placed the washer 45, provided with the annular bearing 52, which, together with the flange 43, compresses the substrate T. The extremity 49 of the tubular body 42 is then peened on to the washer 45 and is thus folded outwards, preferably against the step 48 of the washer 45.

When the eyelet is in the fitted configuration, the annular zone 56 and particularly the protrusions 51 press the substrate T against the lower face 44 of the flange 43, maintaining it in position, especially where the substrate T is fine, delicate and/or elastic.

Figure 6:
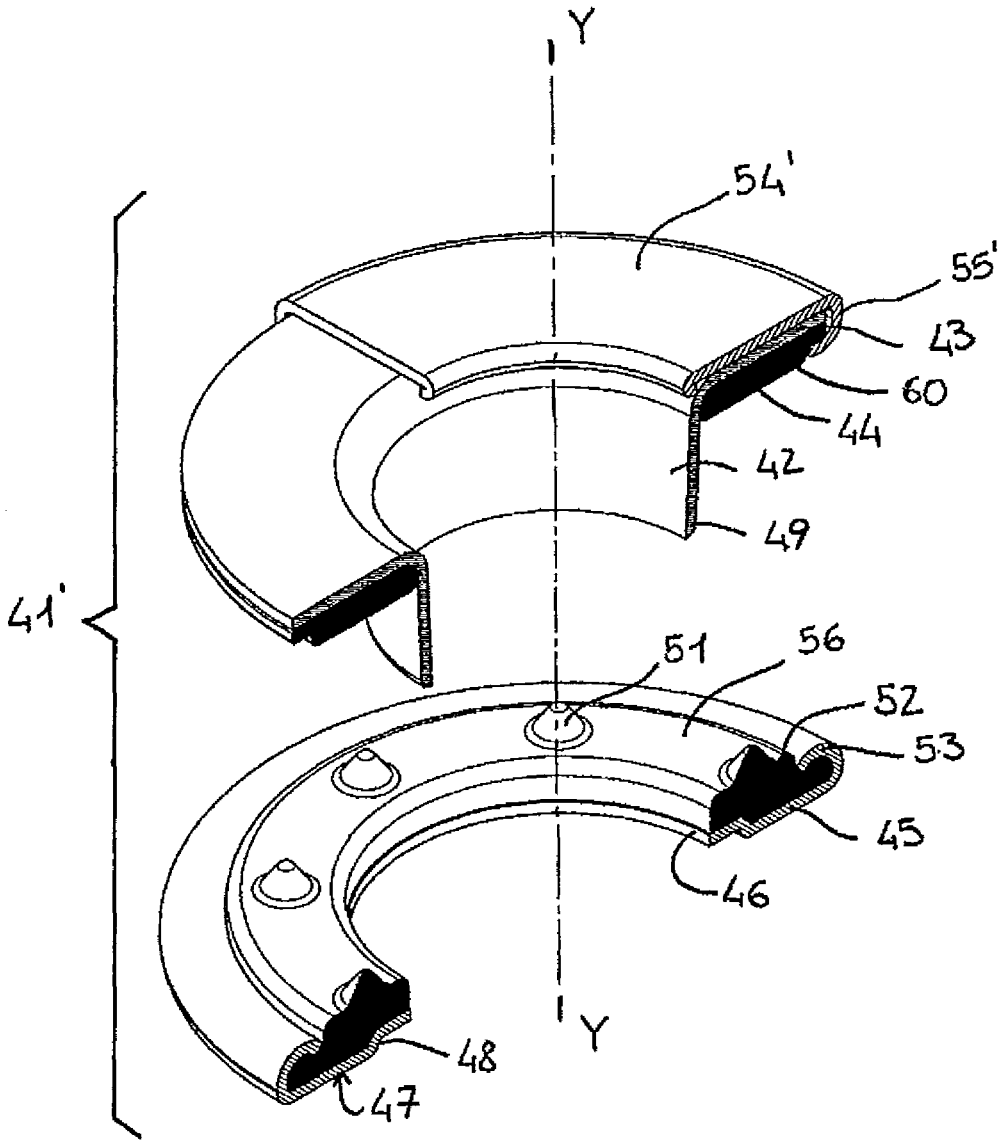
FIG. 6 shows a variant of the third embodiment.

A variant of this third embodiment is illustrated in FIG. 6, where the same reference numbers indicate elements, components and parts of components that are identical to those described previously with reference to FIG. 5. In this variant, an eyelet 41' is essentially identical to the eyelet 41 described above, except for the presence of a second annular pad 60 of pliable material attached to the tubular body 42. In particular, the second annular pad 60 is arranged in contact with the flange 43, from the side facing the tubular body 42. The second annular pad 60 is preferably held in place by a edge 55' of a covering cap 54' of the flange 43, but could also be held by a folded outer edge of the said flange 43, especially where the covering cap 54' is not provided. The second annular pad 60 serves both as a backing element for the protrusions 51 of the annular pad 52 attached to the washer 45 and as an additional element of friction for the substrate T, further enhancing the grip, especially in the case of a fine, delicate and/or elastic substrate.

The invention as described and illustrated in its various embodiments lends itself to many variants.

The protrusions 11, 11', 31, 51 as illustrated in the examples are preferably arranged regularly along the circumference of a circle whose centre passes through the axis of symmetry Y-Y of the eyelets 1, 21, 41, 41'. Naturally, other distributions and configurations of the protrusions are possible with respect to the illustrations provided, for example with protrusions that are radially staggered or different in number from those illustrated (the figures show eyelets with eight protrusions each), or that have a different shape from the virtually conical form shown.

The flanges and the washers of the eyelets may have different shapes from those illustrated, and in particular may be other than circular in shape, even if this is the most common case, and may have visible surfaces other than flat surfaces, for example domed, convex, corrugated, or such like.

Naturally, without prejudice to the principle of the invention, the embodiments and the details of implementation may vary widely with respect to what is described and illustrated here, without departing from the scope of the invention.

The invention claimed is:

1. Reinforcing eyelet for a hole, the reinforcing eyelet defining an axis and comprising:

two annular separate metal plates capable of being fastened, in use, in opposed relation with one another on a substrate, and an annular pad contacting a first of the two annular metal plates and intended to make contact, in use, with the substrate in order to improve its bond to the reinforcing eyelet, the first annular metal plate having an inner edge and an outer edge spaced radially outwardly from the inner edge and defining an outermost periphery of the first annular metal plate, the first annular metal plate being folded over at the outer edge to capture the annular pad between two portions of the folded outer edge in order to hold the annular pad and conceal same from view in the fastened condition of the reinforcing eyelet, the annular pad and the first annular metal plate together having a thickness, as measured in a direction substantially parallel to the axis, which is greater than a thickness, as measured in a direction substantially parallel to the axis, of the folded outer edge.

2. Reinforcing eyelet according to claim 1, in which the annular pad has at least one protruding portion which projects axially beyond the folded outer edge of the said first annular metal plate.

3. Reinforcing eyelet according to claim 1, wherein the annular pad is an integral part of the first annular metal plate, and the reinforcing eyelet comprises a plurality of protrusions which project in a direction substantially parallel to the axis and towards the substrate.

4. Reinforcing eyelet according to claim 3, in which the plurality of protrusions are integrally formed with the annular pad.

5. Reinforcing eyelet according to claim 4, wherein the reinforcing eyelet comprises a further annular pad disposed adjacent a second of the two annular metal plates and in opposed relation with the plurality of protrusions such that the substrate is sandwiched between the plurality of protrusions of the annular pad and the further annular pad.

6. Reinforcing eyelet according to claim 3, in which the plurality of protrusions are made from metal and are integrally formed with a second of the two annular metal plates, the plurality of protrusions being disposed to make contact with the substrate.

7. Reinforcing eyelet according to claim 6, in which the second annular metal plate on which the plurality of protrusions are formed is provided with a covering cap disposed in superimposed relation with a side of the second annular metal plate which faces away from the substrate.

8. Reinforcing eyelet according to claim 7, wherein the annular pad is made from a pliable material and the substrate is sandwiched between the plurality of protrusions and the annular pad.

9. Reinforcing eyelet according to claim 3, in which the plurality of protrusions are distributed in a circular manner with regular spacing.

10. Reinforcing eyelet according to claim 3, in which the protrusions of the plurality of protrusions are essentially conical with a rounded extremity.

11. Reinforcing eyelet according to claim 2, wherein the thickness of the annular pad corresponds to the protruding portion thereof, and the protruding portion is disposed radially inwardly from the outer edge of the first annular metal plate.

12. A reinforcing eyelet for a hole, said reinforcing eyelet defining an axis and comprising:

separate first and second annular metal plates disposed in opposed relation with one another and substantially coaxially with one another on opposite sides of a substrate; and an annular pad disposed for contact with the substrate and between said first and second annular metal plates;

said first annular metal plate having an inner edge disposed adjacent the axis and an outer edge spaced radially outwardly from said inner edge, said first annular metal plate being folded over at said outer edge to capture an outer peripheral edge of said annular pad between two portions of the folded outer edge to hold said annular pad to said first annular metal plate and to conceal said annular pad from view.

13. The reinforcing eyelet according to claim 12, wherein said annular pad has a thickness, as measured in a direction substantially parallel to the axis and disposed radially inwardly of said outer edge, which is greater than a thickness, as measured in a direction substantially parallel to the axis, of said outer edge of said first annular metal plate.

14. The reinforcing eyelet according to claim 13, further comprising a plurality of protrusions which project in a direction substantially parallel to the axis, said protrusions being disposed to engage the substrate.

15. The reinforcing eyelet according to claim 14, wherein said protrusions are formed on said second annular metal plate, said protrusions being disposed in opposed relation with said thickness of said annular pad such that the substrate is sandwiched and compressed between said protrusions and said annular pad.

16. The reinforcing eyelet according to claim 15, wherein said second annular metal plate at an inner edge thereof includes a substantially tubular body extending substantially axially and a flange which projects substantially radially outwardly from one end of said tubular body, said protrusions being formed integrally with said flange and being distributed circumferentially along said flange in a substantially uniform manner, said tubular body having an opposite end spaced axially from said one end which is deformed radially outwardly for engagement with said inner edge of said first annular metal plate.

17. The reinforcing eyelet according to claim 14, wherein said protrusions are formed on said annular pad and said thickness of said annular pad is defined at each of said protrusions, said protrusions being disposed in opposed relation with said second annular metal plate such that the substrate is sandwiched and compressed between said protrusions and said second annular metal plate.

18. The reinforcing eyelet according to claim 17, wherein said first annular metal plate at said inner edge includes a substantially tubular body which extends substantially axially and a flange which projects substantially radially outwardly from one end of said tubular body, said annular pad being located radially between said tubular body and said outer edge of said first annular metal plate, said protrusions being distributed circumferentially along said annular pad in a substantially uniform manner, said tubular body having an opposite end spaced axially from said one end which is deformed radially outwardly for engagement with an inner edge of said second annular metal plate.

19. The reinforcing eyelet according to claim 17, wherein said second annular metal plate at an inner edge thereof includes a substantially tubular body which extends substantially axially and a flange which projects substantially radially outwardly from one end of said tubular body, said annular pad being located radially between said tubular body and said outer edge of said first annular metal plate, said protrusions being distributed circumferentially along said annular pad in a substantially uniform manner, said tubular body having an opposite end spaced axially from said one end which is deformed radially outwardly for engagement with said inner edge of said first annular metal plate.

20. The reinforcing eyelet according to claim 19, wherein said annular pad is a first annular pad and said reinforcing eyelet includes a second annular pad disposed between said flange and said first annular pad such that the substrate is sandwiched and compressed between said second annular pad and said protrusions of said first annular pad.

21. Reinforcing eyelet according to claim 1, wherein the part of the annular pad over which the outer edge of the first annular metal plate is folded is an outermost edge of the annular pad.

* * * * *